US005086633A

United States Patent [19]

Meyerle

[11] Patent Number: 5,086,633

[45] Date of Patent: Feb. 11, 1992

[54] OPPOSED MOTION, MOMENTUM BALANCED-AT-IMPACT PUNCH PRESS

[76] Inventor: George M. Meyerle, 17 Lakeview Dr., Brookfield, Conn. 06804

[21] Appl. No.: 548,001

[22] Filed: Jul. 5, 1990

[51] Int. Cl.[5] ..... B21J 7/46; B21J 7/30; B26D 5/00; B30B 5/00

[52] U.S. Cl. ..... 72/24; 72/407; 72/420; 72/430; 83/577; 83/72; 100/264

[58] Field of Search ..... 72/407, 453.01, 453.1, 72/453.13, 453.14, 453.18, 456, 17, 20, 24, 25, 420, 421, 426, 429, 430, 441; 83/575, 637, 588, 577, 72, 732; 100/218, 254, 264

[56] References Cited

U.S. PATENT DOCUMENTS

| | | | |
|---|---|---|---|
| 2,742,802 | 4/1956 | Clarke et al. | 72/4 |
| 3,070,146 | 12/1962 | Ferranti | 72/20 |
| 3,261,197 | 7/1966 | Weyer | 72/407 |
| 3,339,397 | 9/1967 | Heimel | 72/453.01 |
| 3,709,083 | 1/1973 | Doherty | 72/430 |
| 4,022,090 | 5/1977 | Doherty et al. | 72/430 |
| 4,056,029 | 11/1977 | Doherty et al. | 72/430 |
| 4,135,770 | 1/1979 | Doherty | 384/30 |
| 4,142,397 | 3/1979 | Heimel | 72/453.18 |
| 4,604,930 | 8/1986 | Avila et al. | 83/588 |
| 4,607,516 | 8/1986 | Schafer et al. | 72/422 |
| 4,862,043 | 8/1989 | Zieve | 72/430 |

FOREIGN PATENT DOCUMENTS

| | | | |
|---|---|---|---|
| 0659269 | 4/1979 | U.S.S.R. | 72/407 |

*Primary Examiner*—Lowell A. Larson
*Assistant Examiner*—Thomas C. Schoeffler
*Attorney, Agent, or Firm*—Parmelee, Bollinger & Bramblett

[57] ABSTRACT

A punch press is oriented horizontally with the first and second opposed tools being mounted on first and second members both of which are movable horizontally. These motion members are driven with rapid acceleration toward each other for impacting the fast-moving first and second tools simultaneously against opposite sides of material to be formed between the tools. The two opposed motion members are arranged for the momentum of the first tool with its associated moving parts at the instant of impact be equal to the momentum of the second tool with its associated moving parts so that equal and opposite impulses resulting from momentum cancel each other out. As a result of this opposed motion with momentum-balanced-at-impact, very little energy or work is wastefully lost into the platform on which the punch press is supported and only an insignificant or very modest amount of mechanical shock and vibrations are induced into t he platform. Thus, very little noise is transmitted into the environment via the platform. The material to be formed is fed into the region between the first and second tools by a feed plate which is also movable horizontally in either direction. Various arrangements are disclosed for appropriately positioning the feed plate between the opposed tools for achieving simultaneous impact of the tools against opposite sides of the material to be formed.

35 Claims, 2 Drawing Sheets

OPPOSED MOTION, MOMENTUM BALANCED-AT-IMPACT PUNCH PRESS

FIELD OF THE INVENTION

The present invention is in the field of punch presses, and more particularly relates to a horizontally-oriented punch press wherein two opposed tooling components are suddenly driven toward each other for simultaneously impacting at high velocity against opposite sides of the material to be formed.

BACKGROUND

In a conventional electromagnetically driven punch press, such as shown in the Doherty U.S. Pat. Nos. 3,709,083, 4,022,090, 4,056,029 and 4,135,770, the upper one of the two opposed tooling components is driven vertically downwardly during the power stroke, and the lower tooling component remains stationary. Thus, there is a large downward impact occurring against the lower tooling component at the instant when the fast-moving upper tool impacts down upon the material to be formed between the upper and lower tooling. For example, the lower tool is a die and the upper tool is a punch which impacts down against a strip of steel material for punching finished pieces, such as washers, out of the steel strip.

As a result of such large downward impacts occurring against the lower tool in a conventional punch press, it is necessary to mount the whole punch press on a strong and massive work table, so as to be able to withstand the large mechanical shocks and vibrations being transmitted from the punch press down into its supporting work table. Moreover, it is necessary to provide strong flooring in the manufacturing plant where the punch press is operating so as to be able to withstand the heavy loading and mechanical stresses being imposed on the building day-after-day where the punch press is operated.

Furthermore, in spite of providing a strong massive work table and in spite of providing a strong factory floor, there is a disturbing "whomp" or "thump" which is transmitted repeatedly throughout the manufacturing plant and which can be felt by occupants of the building regardless of whether they are standing or sitting. Consequently, it is usual practice to locate punch presses in a remote area in a building or in a separate building so that the frequent "whomp" or "thump" does not unduly disturb other workers and office personnel.

It is to be appreciated that such mechanical shocks and vibrations which are disturbing to occupants of a building indicate that a relatively large amount of wasted energy is being transmitted from the punch press into its supporting work table and into the building structure. In other words, conventional punch presses are relatively inefficient machines. While they are performing their intended work on the material in the punch press, they are also performing wasteful work in shaking work tables, floors and walls of the buildings in which they are operating. Such wasteful work in shocking and shaking buildings tends to deteriorate buildings more rapidly than normal aging and is disturbing and possibly is detrimental to human beings who might be subjected to extended periods of nearby exposure to convention punch presses.

As a further comment about the problems caused by conventional punch presses, it is helpful to think about a piano or other stringed instrument. The majority of the sound which issues from a piano or from another stringed instrument does not come from the vibrating string itself. Rather, the major portions of the sound energy are radiated from a sounding board or sounding box which is mechanically connected to a vibrating string so as to be forced to vibrate with the string. The relatively large area of a vibrating sounding board or box couples well with gaseous air and is an efficient transmitter of sound energy into gaseous air whereas a vibrating string itself has a relatively small area and does not efficiently couple with the air and thus by itself does not transmit much sound energy into air. Similarly, the tooling itself and material to be formed in a punch press have a relatively small area a compared with the frame of the punch press plus the work table on which it is mounted, plus the floor and walls of the building in which it is operating.

Therefore, in my view, the major energy content of the very loud, disturbing noises produced by operating a conventional punch press is coupled to the air by and is radiated (broadcast) into the air from the punch press frame, from its work table or platform and from floor and walls of the room where it operates.

Conversely, in my view, only a relatively small proportion of the very loud total noise energy is radiated into the air by the tooling and material themselves. My experiments with a prototype set-up embodying the present invention have shown that the noise level in a room is reduced by about twenty decibels by employing a horizontally-oriented, opposed motion, momentum-balanced-at-impact punch press embodying the present invention, as compared with a conventional vertical punch press of the same tonnage rating.

SUMMARY

In a punch press embodying the present invention, both of the opposed tools are simultaneously driven horizontally toward each other, so as to impact simultaneously against opposite surfaces of the material to be formed with substantially equal momentum at the instant of impact.

Momentum is a physical quantity which has the units of force and time. For example, the units of momentum are "pound seconds" or "dyne seconds". Momentum is calculated by multiplying the moving mass times its velocity and often is expressed by "MV".

The mechanical impulse which is transmitted by the tool to the material being formed is a function of the momentum of the tool and its associated moving parts at the instant of impact of the tool against the material to be formed.

When the momentum of one horizontally moving tool is exactly equal to the momentum of the opposed horizontally moving tool at the instant when these two converging tools impact at fast velocity against opposite sides of the material being formed, then their impulses being applied to the material from opposite directions are exactly equal and opposite, so that these opposed equal impulses cancel each other out. Consequently, if such exact equality of momentum is achieved, the strip of material being formed remains stationary. Thus, the feeder which is feeding this strip of material also remains stationary. Consequently, there are no significant mechanical shocks or vibrations being mechanically transmitted into the frame of the horizontally-oriented punch press nor into its supporting work table, nor into the floor and walls of a room in which it is operating. A much more efficient, much less noisy, a much less disturbing, and a much more environmentally friendly technology is thereby achieved.

Therefore, in a horizontally-oriented opposed motion punch press embodying the present invention, the objective is to achieve substantially equal amounts of momentum in the two opposed, converging, fast-moving tools at their instant of impact against opposite sides of the material being formed between the impacting tools.

Unlike a conventional punch press, a horizontally-oriented, opposed-motion punch press with momentum-balanced-at-impact does not rely upon a massive, strong, solid support platform upon which to impose the powerful, downwardly-directed working impact.

Only an insignificant or very modest amount of wasted energy or work is lost into a platform or work table supporting a horizontally-oriented, opposed-motion, momentum-balanced-at-impact punch press embodying the present invention during each operating cycle of the punch press.

An insignificant or very modest amount of noise is transmitted into the environment via the platform or work table supporting such a punch press embodying the present invention.

An insignificant or very modest amount of mechanical shock and vibrations are induced into a platform or work table supporting such a punch press embodying the present invention.

A horizontally-oriented, opposed-motion, momentum-balanced-at-impact (MBAI) punch press as an embodiment of this invention can readily be isolated from the environment using very soft mounting cushions or may even be hung from an overhead ceiling.

By virtue of the fact that an insignificant or very modest amount of mechanical shock, vibrations and noise are induced into the platform or work table supporting such a punch press, such punch press itself can be enclosed very effectively within a sound-deadening, sound-absorbing enclosure.

By virtue of the fact that a massive, strong, solid and heavy support platform and a consequent strong flooring are not required for such a punch press, the punch press itself becomes relatively portable, because it can be set up upon an ordinary work bench or work table.

By virtue of the fact that an insignificant or very modest amount of mechanical shock, vibrations and noise are transmitted into the environment of such punch press, a designer now has the opportunity to integrate this new technology into high energy punch press work-performing installations at convenient locations in an existing manufacturing plant rather than using the traditional expedient approach of locating high energy punch press work-performing equipment at remote locations, which often are inconvenient and cause difficulties in materials handling, or else use the last-resort expedient of locating such high energy punch press operations at an expensive, off-site punch press processing station.

BRIEF DESCRIPTION OF THE DRAWINGS

The various additional features, aspects, advantages and objects of the present invention will become more fully understood from a consideration of the following detailed description of presently preferred embodiments, together with the accompanying drawings, which are not drawn to scale but rather are arranged for clarity of illustration and explanation. In the drawings.

DETAILED DESCRIPTION OF PREFERRED EMBODIMENTS

Figure 1:
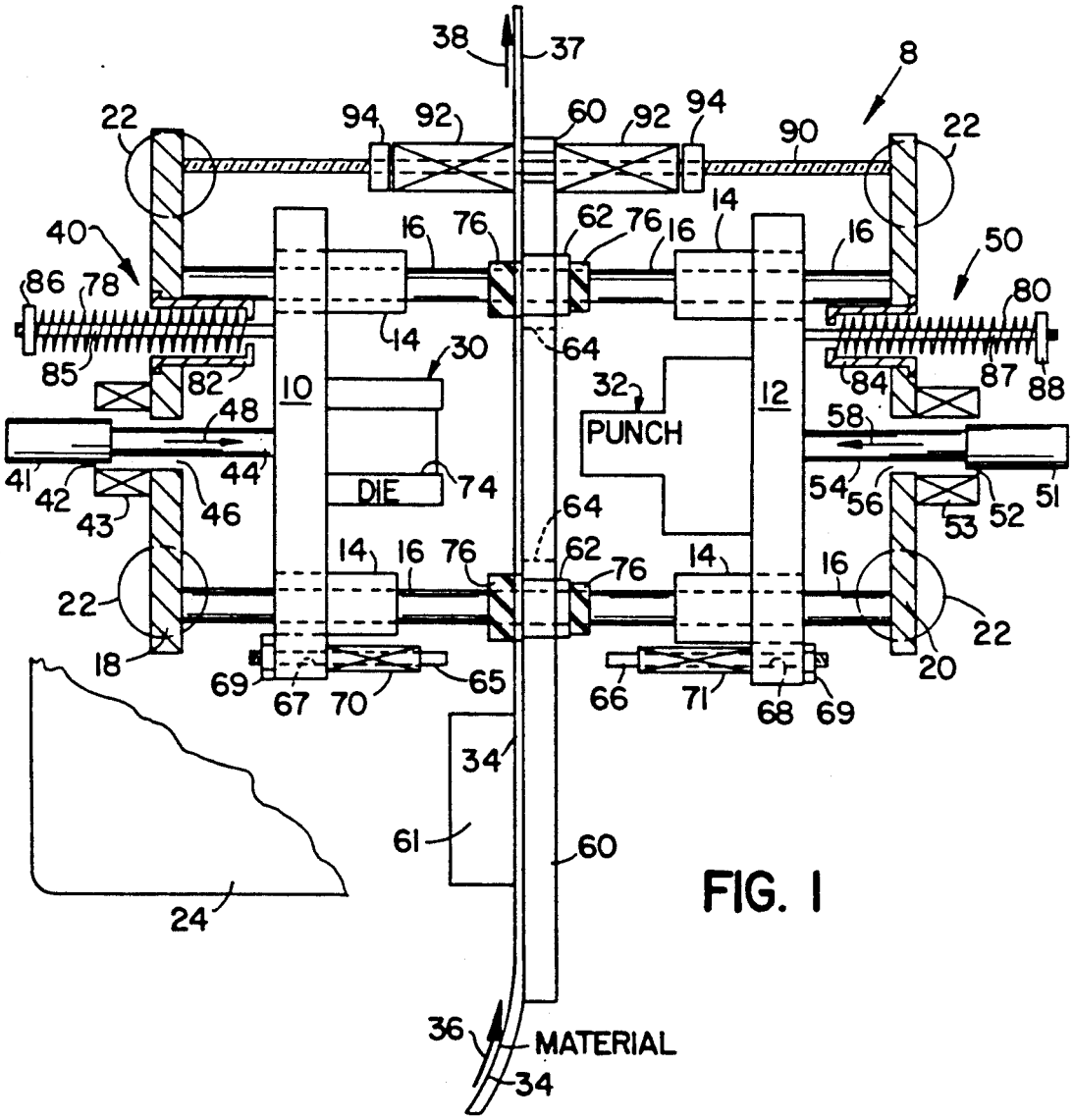
FIG. 1 is a top plan view, with portions shown in section, of a horizontally-oriented, opposed-motion, momentum-balanced-at-impact punch press embodying the present invention.

The horizontally-oriented punch press 8 in FIG. 1 includes first and second motion members 10 and 12 in the form of two opposed horizontally movable plates. The first motion member 10 is supported by a plurality of bushings 14 which are freely movable longitudinally along a plurality of horizontal guide pins 16. The opposite ends of these guide pins 16 are secured to first and second mounting members 18 and 20, respectively, seating upon a plurality of resilient soft, cushioning foot pads 22 which rest upon a work table 24, for example, these foot pads 22 are formed of soft, resilient polyurethane. Only a corner of the work table 24 is shown broken away for clarity of illustration The second motion member 12 is also supported by a plurality of bushings 1 which are freely movable longitudinally along the guide pins 16.

During operation of this press 8, the mounting members 18 and 20 remain essentially stationary on their resilient foot pads 22. Advantageously, there are insignificant amounts of vibration and mechanical shock which become transmitted into the work table 24 when opposed tooling components 30 and 32 impact against opposite sides of material 34 to be formed in this punch press.

The opposed tooling components 30 and 32 are mounted to and are carried by the respective first and second motion members 10 and 12; for example, this tooling is shown as a die 30 and a punch 32 which cooperate for forming the material 34, as will be explained in detail later. A strip of this material 34 is fed into one side of the punch press 8 as indicated by an infeed arrow 36, and this formed material 37, after it has been impacted by the tooling 30, 32 is then fed out of the other side of the punch press as indicated by an outfeed arrow 38.

In order to drive the two opposed motion members 10 and 12 toward each other with rapid acceleration and resultant high velocity at the instant of impact by the tooling 30, 32 against opposite sides of the material 34, there are first and second electromagnetic thrust motors 40 and 50 shown mounted upon the respective mounting members 18 and 20. The first electromagnetic thrust motor 40 includes a solenoid winding (coil) 43 mounted on the mounting member 18 and having a horizontally extending winding opening 42. A ferromagnetic armature 41 is horizontally movable within the winding opening 42 and is connected by a strong, rigid non-magnetic push rod 44 to the motion member 10. For example, this non-magnetic push rod 44 is made of non-magnetic stainless steel. The push rod 44 extends through an opening 46 in the mounting member 18.

Upon sudden, electrical energization of the solenoid winding 43, the armature 41 is suddenly forcefully drawn more fully into the winding opening 42, thereby exerting a sudden powerful thrust through the push rod 44 as indicated by a thrust arrow 48 for rapidly accelerating the motion member 10 toward the opposed motion member 12 with resulting relatively high velocity.

Similarly, the second electromagnetic thrust motor 50 includes a solenoid winding (coil) 53 mounted on the mounting member 20 and having a horizontally extending winding opening 52. There is a ferromagnetic armature 51 horizontally movable within the winding opening 52 and connected by a strong, rigid non-magnetic push rod 54 to the motion member 12. In this example, this non-magnetic push rod 54 is made of non-magnetic stainless steel. This push rod 54 extends through an opening 56 in the mounting member 20.

When the solenoid winding 53 is suddenly electrically energized, the armature 51 becomes forcefully suddenly drawn into the winding opening 52. Thus, the armature 51 exerts a sudden powerful thrust through the push rod 54 as indicated by a thrust arrow 58. This powerful sudden thrust 58 rapidly accelerates the motion member 12 toward the opposed motion member 10, thereby producing a relatively high velocity.

The objective is for the punch 32 and die 30 to come together each at a high velocity impacting simultaneously against opposite surfaces of the material 34 located between the punch and die so that the energy of motion of the fast-moving components on both sides of the material 34 is converted into useful work in forming the material 34.

In order to assure that the material 34 is appropriately positioned for being simultaneously impacted from opposite directions by the punch 32 and die 30, there is an automatic strip material feeder 61 mounted upon a horizontally free-moving feed plate 60. This feed plate 60 is supported by a plurality of bushings 62 mounted on the feed plate and freely movable along the guide pins 16. For providing clearance for the tooling 30, 32 there is a large clearance opening 64 in the feed plate in the region where the tooling elements 30, 32 come together at high velocity against opposite sides of the material 34 for forming it during each cycle of operation of the punch press 8.

The horizontal position of this free-moving feed plate between the opposed motion members 10 and 12 in some embodiments of this invention is controlled by a pair of opposed probe pins 65 and 66 which are freely slidably mounted in bore holes 67 and 68 in the respective motion members 10 and 12, respectively. These probes 65 and 66 are retained in their respective boreholes by probe-position adjustment means 69, for example a knurled screw adjustment wheel screwed onto the threaded rear end of the probe pin. Compression springs 70 and 71 on these probe pins 65 and 66 are anchored to the respective probe pins near their tips and are seated against the respective motion members for urging these probes toward each other to their fully extended positions as shown. These fully extended positions are adjusted by turning the knurled adjustment screw wheels 69 along the threaded rear ends of the probe pins.

These probe pins 65 and 66 are positioned directly opposite to each other so that the tips of these probe pins can come into contact with opposite surfaces of the feed plate 60 which carries the material 34 to be formed.

In operation, the two solenoid windings 43 and 53 are suddenly simultaneously energized for thrusting the two motion members 10 and 12 toward each other with rapid acceleration as shown by the thrust arrows 48 and 58. Assuming for purposes of explanation that the material 34 is not exactly positioned so as to be simultaneously impacted by the punch and die 32, 30, then one of these probes 65, 66 will come into contact with the free-moving feed plate 60 before the other probe comes into contact with it. If probe 65 is the prior contactor, it will push against the free-moving feed plate 60 causing it to become shifted toward the right in FIG. 1 until the opposite probe 66 subsequently comes into contact with its other side. Conversely, if probe 66 is the prior contactor, it will push against the feed plate 60 causing it to become shifted toward the left in FIG. 1 until the opposite probe 65 comes into contact with it. Then, with both probes now contacting the feed plate, the material 34 is centered between the punch and die, and immediately thereafter they impact against the material 34 to form it.

As the punch and die 32, 30 are forming the material, the motion members 10 and 12 are moving toward each other, and the probes 65, 66 become momentarily retracted by sliding back in their respective mounting holes 67, 68 while the springs 70 and 71 become momentarily slightly depressed.

The probe pins 65 and 66 are identical and their springs 70 and 71 are identical. These two probe springs 70 and 71 are sufficiently stiff that neither is compressed while its associated probe is shifting (repositioning) the feed plate 60. After both probes 65 and 66 have come into contact with opposite surfaces of the feed plate 60, these probe springs then become compressed as the simultaneously retracting probes are allowing the fast-moving punch and die 32, 30 to simultaneously impact against the material 34 for forming it.

Depending upon the shape of the finished parts, either scrap or finished parts are ejected through a die opening 74 and pass out through an outlet hole (not shown) in the motion member 10, being collected in a bin under the work table 24. If finished parts are being pushed out through the die opening 74, then the outfeed strip 37 is scrap. If scrap pieces are being pushed through the die opening, then the outfeed strip 37 is the finished part.

After the feed plate 60 has been appropriately positioned by the probes 65 and 66 during a first operating cycle of the punch press 8, the feed plate 60 does not again become significantly shifted in position so long as none of the operating parameters is changed. In other words, the probes 65 and 66 serve to position the feed plate 60 during a first cycle of operation of the press 8, and thereafter the press 8 remains balanced at impact, because impact is occurring simultaneously against opposite sides of the material 34 while the feed plate 60 is remaining essentially stationary.

An example of a parameter which could change and cause a temporary loss of balance at impact is an increase in friction in one of the motion member bushings 14 due to insufficient lubricant. The resulting friction would cause one of the motion members 10 or 12 to be moving slower at impact, thus having slightly less momentum at impact than previously, causing a momentum imbalance at impact. The probes 65 and 66 would thereupon slightly reposition the feed plate 60, thereby providing a slightly longer thrust stroke for the reduced momentum motion member and a slightly shorter thrust stroke for the larger momentum motion member for enabling the respective momentum to become equalized at impact. In other words, momentum balance at impact will have become reestablished, and the feed plate 60 will now remain at its new location for providing momentum balance at impact, until such time as one of the operating parameters again becomes changed, at which time the probes 65, 66 will again establish another new position for the feed plate 60 for providing momentum balance at impact.

The equation for momentum balance at the instant of impact is:

$$(1)\ M_1V_1=M_2V_2$$

where $M_1$ is the total mass of the first motion member 10 and the components which move with this first motion member 10, including die 30 and bushings 14, $V_1$ is the velocity of this first motion member 10 and its die 30 at the instant of impact, and where $M_2$ is the total mass of the second motion member 12 and the components which move with this second motion member 12, including punch 32 and bushings 14, and $V_2$ is the velocity of this second motion member 12 and its punch 32 at the instant of impact.

After the material 34 has been formed by the die and punch 30, 32, residual motion of the members 10 and 12 toward each other is stopped by the motion member bushings 14 coming against tough, durable, resilient bumpers 76 mounted on both ends of the feed plate support bushings 62.

As soon as the motion members 10 and 12 have been stopped by the bumpers 76, respective return springs 78 and 80 serve to return these motion members to their initial positions. These motion members 10 and 12 are shown in their respective initial positions in FIG. 1. These return springs 78 and 80 are seated in respective spring cups 82 and 84 mounted in sockets in the mounting members 18 and 20. A return spring rod 85 is secured to the motion member 10 and extends through the spring cup 82 and through the spring 78 to an adjustable locknut 86 screwed onto the spring rod 85 and serving to adjust the initial compression in the spring 78 for adjusting the rate of return of the motion member 10. Similarly, a return spring rod 87 is fastened to the motion member 12 and extends through the spring cup 84 and through the spring 80 to an adjustable locknut 88 threaded onto the spring rod 85 and used for adjusting the initial compression in spring 80 for adjusting the rate of return of the motion member 12.

In order to establish an initial horizontal starting point for the free-moving feed plate 60, there is a screw threaded adjusting rod 90 which is secured to and extends between the first and second mounting members 18 and 20. A pair of identical and relatively compliant springs 92 on this rod 90 seat against opposite sides of the feed plate 60. Screw adjustment thumb wheels 94 are used to set an initial approximate starting point for the free-moving feed plate. In other words, this free-moving feed plate 60 is set to an initial desired position by the thumb wheels 94 cooperating with their compliant springs 92, and this initial position corresponds approximately with the expected momentum-balance-at-impact position to be established by the probes 65 and 66. Then, the thumb wheels 94 are again adjusted to match the actual momentum-balance-at-impact position of feed plate 60 which is produced by the probes.

Another embodiment of this invention for establishing momentum-balance-at-impact is provided by using identical thrust motors 40 and 50 and by very closely equalizing the moving masses $M_1$ and $M_2$ in Equation (1) above. Then, the solenoid windings are simultaneously equally energized by electrically connecting them in series, so that equal electrical currents flow through these two identical windings in series, or they are connected in parallel to the same electrical power source and their impedances are equalized, so that equal electrical currents flow through the two identical windings. If the masses $M_1$ and $M_2$ are carefully equalized and if the thrusts 48 and 58 are also carefully equalized, then momentum-balance-at-impact can be achieved without using the probe mechanisms 65, 70 and 66, 71.

Figure 2:
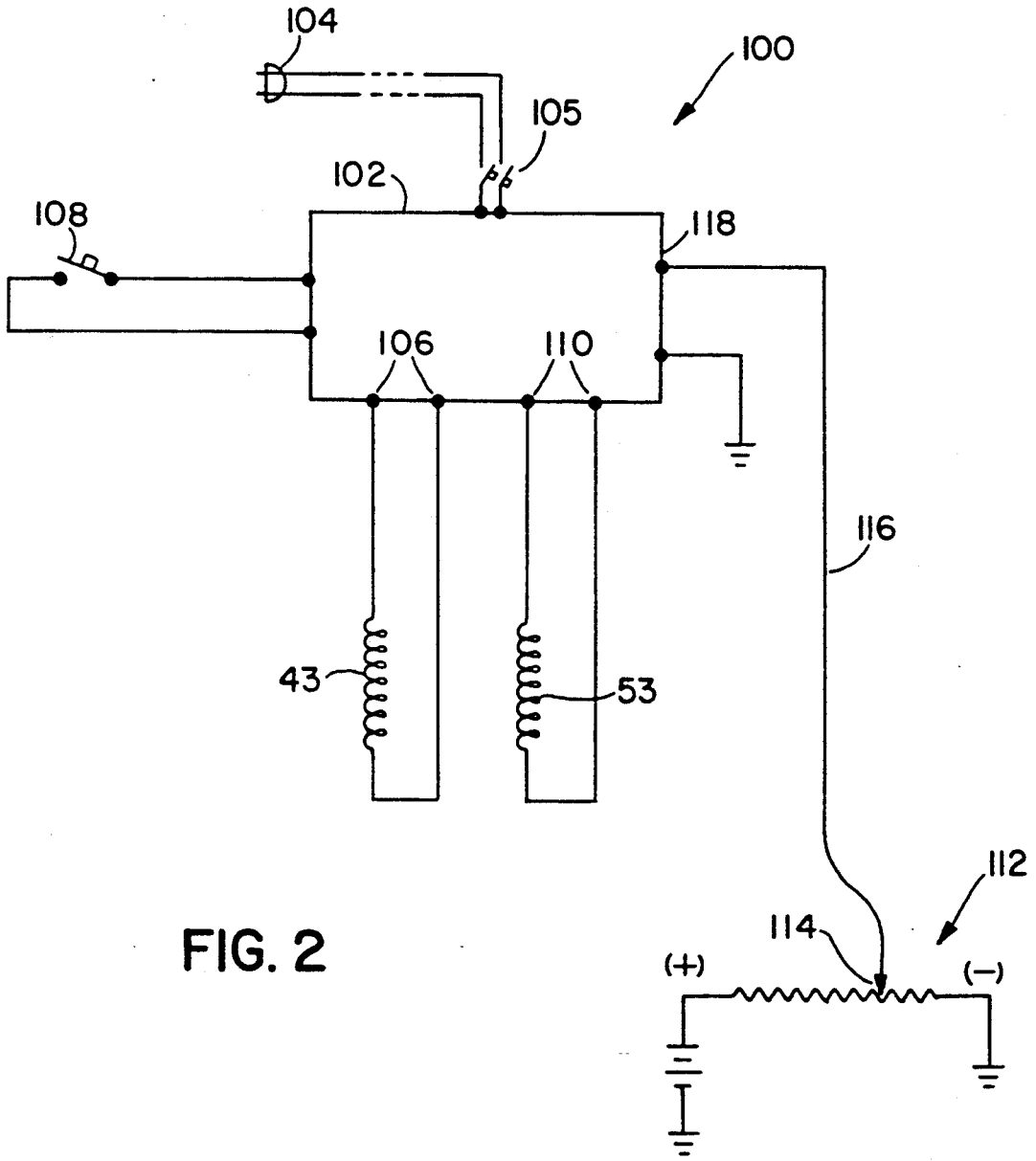
FIG. 2 is a schematic electrical diagram of an electrical control circuit, which is an alternative embodiment of means for automatically balancing the momentum of the two opposed, converging, fast-moving tools at the instant of their impact against opposite sides of the material being worked.

A further embodiment of this invention for providing momentum-balance-at-impact is a control circuit 100, shown in FIG. 2. A controller 102 is provided with electrical power from a conventional alternating current power source, for example a plug 104 and an on/off switch 105. A pair of terminals 106 at the controller 102 are connected to the solenoid winding 43 for suddenly energizing this winding 43 when a "firing" switch 108 is closed. Another pair of terminals 110 are similarly connected to the other solenoid winding 53 for suddenly energizing it upon closure of the firing switch 108.

A sensor 112 for sensing shifts in position of the feed plate 60 is used. For example, this sensor 112 is shown as a potentiometer which is held stationary by connection to one of the mounting members 18 and 20. This potentiometer has a movable contact 114 mechanically connected to the feed plate 60, so that this potentiometer provides a change in a voltage feedback signal on a sensor lead 116 connected to a sensor terminal 118 of the controller 102 if the feed plate 60 is caused to move by momentum imbalance at impact. In response to such a change-in-position electrical signal at its sensor terminal 118, the controller 102 slightly changes the relative electrical energizations of the solenoid windings 43 and 53, so as to modify slightly the relative magnitudes of the thrusts 48 and 58 for reestablishing momentum-balance-at-impact whenever the firing switch 108 is again closed. It will be understood that the change-in-position sensor 112 may comprise a magnetic motion detector, an optical sensor or position detector.

Instead of using electromagnetically driven thrust motors 40 and 50, it will be understood that the thrusts 48 and 58 can be provided by using compressed air cylinders with piston rods 44 and 54. In order to develop the sudden, powerful thrusts 48 and 58, compressed air is suddenly introduced into the respective air cylinders for applying a sudden powerful push to the respective pistons which are connected to piston rods 44 and 54. Thus, the two respective air cylinders are mounted where the solenoid windings 43, 53 are mounted, and their pistons are located where the armatures 41 and 51 are shown. It is my preference to use electromagnetically driven thrust motors rather than compressed air motors, because the sudden application of electrical energization to the solenoid windings 43, 53 is more precisely controlled and modified for achieving the desired large magnitudes of thrusts accompanied by momentum balance at impact, whereas the sudden introduction of compressed air into two air cylinders is not so readily precisely controlled and modified for achieving the same balanced results.

Since other changes and modifications varied to fit particular operating requirements and environments will become recognized by those skilled in the art, the invention is not considered limited to the examples chosen for purposes of illustration of presently preferred embodiments and includes all changes and modifications which do not constitute a departure from the true spirit and scope of this invention as claimed in the following claims and equivalents of the claimed elements.

I claim:

1. In a punch press capable of punching and forming including a first member adapted to have a first tool supported thereon and a second member adapted to have a second tool supported thereon for forming material between said first and second tools by impact, the method of operating the punch press comprising the steps of:

arranging for motion of said first tool support member in a first direction from a first initial position and then returning in a second direction opposite to said first direction, arranging for motion of said second tool support member in said second direction from a second initial position with said second tool aligned with said first tool in opposed relation to said first tool and then returning in said first direction, movably supporting material to be formed in a region between said first and second initial positions, said supporting of said material being movable in both said first and second directions, accelerating said first tool support member in said first direction from said first initial position with said first tool moving forward and impacting against a first side of said material, accelerating said second tool support member in said second direction from said second initial position with said second tool moving toward and impacting against a second side of said material for forming the material between said first and second tools, and moving the movably supported material in one of said first and second directions for causing said first and second tools to impact substantially simultaneously against the respective first and second sides of the material.

2. The method of operating a punch press claimed in claim 1, including:

sensing a difference between an instant of impact of said first tool against the first side of the material and an instant of impact of said second tool against the second side of the material, and reducing such difference during a subsequent operation of the punch press.

3. The method of operating a punch press claimed in claim 1, including the steps of;

sensing a momentum associated with said first tool prior to impact of said first tool against the material, sensing a momentum associated with said second tool prior to impact of said second tool against the material, and substantially equalizing such momentums at impact by moving the movably supported material in one of said first and second directions while said first and second tools are moving toward said first and second sides of the material, respectively.

4. The method of operating a punch press claimed in claim 1, characterized by:

applying first driving force to said first tool support member for accelerating said first tool support member in said first direction from said first initial position, applying second driving force to said second tool support member for accelerating said second tool support member in said second direction from said second initial position, and controllably modifying at least one of said driving forces while said first and second tools are moving toward said first and second sides of the material, respectively, for substantially equating momentum associated with said first tool at impact with momentum associated with said second tool at impact.

5. The method of operating a punch press claimed in claim 1, including the steps of:

sensing a difference between a momentum associated with said first tool and a momentum associated with said second tool during a cycle of operation of the punch press, and minimizing said difference during a next cycle of operation of the punch press.

6. The method of operating a punch press claimed in claim 5, wherein:

said minimizing of said difference in momentum is provided by manually adjusting positioning in one of said first and second directions of the movably supported material prior to an operating cycle of the punch press subsequent to an operating cycle during which said sensing occurs.

7. The method of operating a punch press claimed in claim 1, including the steps of:

sensing a velocity associated with said first tool prior to impact of said first tool against the material, sensing a velocity associated with said second tool prior to impact of said second tool against the material, and substantially equalizing such velocities.

8. The method of operating a punch press claimed in claim 7, wherein:

such velocities are substantially equalized by modifying an accelerating force applied to at least one of said tool supporting members.

9. The method of operating a punch press claimed in claim 1, including the step of:

providing momentum of first moving mass associated with said first tool substantially equal with momentum of second moving mass associated with said second tool when said first and second tools are impacting against the material.

10. The method of operating a punch press claimed in claim 9, characterized by the further steps of:

sensing motion of the material during forming of the material during a cycle of operation of the punch press for sensing imbalance between momentum of said first moving mass and momentum of said second moving mass during forming of the material, and repositioning the material in one of said first and second directions prior to a subsequent cycle of operation for minimizing motion of the material during forming of the material in said subsequent cycle of operation.

11. The method of operating a punch press claimed in claim 9, including the steps of:

providing first moving mass associated with said first tool substantially equal with second moving mass associated with said second tool, applying first force to said first tool support member for accelerating said first tool support member in said first direction, applying second force to said second tool support member for accelerating said second tool support member in said second direction, and providing said first force substantially equal with said second force for accelerating said first tool to velocity substantially equal with velocity produced by accelerating said second tool for causing the momentum of said first moving mass associated with said first tool to be substantially equal with the momentum of said second moving mass associated with said second tool when said first and second tools are impacting against the material.

12. The method of operating a punch press claimed in claim 11, including the step of:

moving the material in one of said first and second directions while said first and second tools are moving toward opposite sides of the material for causing said first and second tools to impact substantially simultaneously against the first and second sides of the material.

13. The method of operating a punch press claimed in claim 11, including:

sensing motion of the material during forming of the material during a cycle of operation of the punch press, and changing at least one of said first and second forces during a subsequent cycle of operation for changing acceleration of at least one of said tool support members during said subsequent cycle of operation for minimizing motion of the material during forming of the material during said subsequent cycle of operation.

14. The method of operating a punch press as claimed in claim 11, including the steps of:

sensing a difference between said accelerating of said first tool support member and said accelerating of said second tool support member during a cycle of operation of the punch press, and minimizing said difference during a subsequent cycle of operation of the punch press.

15. The method of operating a punch press claimed in claim 14, wherein:

minimizing said difference in accelerating by changing at least one of said first and second forces for changing acceleration of at least one of said tool support members during an operating cycle of the punch press subsequent to an operating cycle during which said sensing occurs.

16. The method of operating a punch press comprising the steps of:

positioning material to be formed between first and second forming tools each initially spaced substantially the same distance away from respective opposite sides of the material providing substantially identical first and second electromagnetic thrust motors coupled to said first and second forming tools, respectively, substantially equalizing the moving masses operatively associated with said first and second forming tools, simultaneously initiating delivery of substantially equal electrical power to said first and second electromagnetic thrust motors for applying substantially equal thrusts to said first and second forming tools for substantially simultaneously equally accelerating said first and second forming tools with substantially equal velocities in opposite directions toward the material between them for substantially simultaneously impacting said tools against opposite sides of the material for forming the material, movably supporting said material to be formed between said first and second forming tools for enabling motion of the material in either of said opposite directions.

17. The method of operating a punch press claimed in claim 16, comprising the further steps of:

connecting said first and second electromagnetic thrust motors to a controllable source of electrical power, and compliantly positioning the movably supported material between said first and second forming tools for permitting motion of the material in either of said opposite directions.

18. The method of operating a punch press claimed in claim 17, including the further step of:

sensing shifting in position of the material in either of said opposite directions during forming, and during a next cycle of operation of said punch press relatively increasing delivery of electrical power to one of said first and second electromagnetic thrust motors toward which the material had shifted during forming.

19. The method of operating a punch press claimed in claim 18, in which:

relatively increasing delivery of electrical power to one of said first and second electromagnetic thrust motors toward which the material had shifted during forming involves relatively decreasing delivery of electrical power to one of said first and second electromagnetic thrust motors away from which the material had shifted during forming.

20. In a punch press including a first member adapted to have a first tool mounted thereto and a second member adapted to have a second tool mounted thereof for forming material between said tools, the apparatus comprising:

first means supporting said first member for enabling motion in a first direction, second means supporting said second member in opposed relation to said first member for enabling motion of said second member in a second direction opposite to said first direction, first electromagnetic thrust means connected to said first member for thrusting said first member in said first direction for accelerating said first member in said first direction, second electromagnetic thrust means connected to said second member for thrusting said second member in said second direction for accelerating said second member in said second direction, feeding means for feeding material into a region between said first and second tools for impacting said first and second tools against opposite sides of the material for forming the material between said first and second tools said feeding means being movable in said first and second directions, and resilient positioning means for resiliently positioning said feeding means in the region between said first and second tools for obtaining substantially simultaneous impact of said first and second tools against opposite sides of the material.

21. In a punch press, apparatus as claimed in claim 20, further comprising:

sensing means for sensing shift in position of feeding means in either of said first and second directions during forming of the material between said first and second tools, electrical energization means connected to said first and second electromagnetic thrust means for simultaneously energizing said first and second electromagnetic thrust means, firing means connected to said electrical energization means for controlling said electrical energization means for suddenly simultaneously energizing said first and second electromagnetic thrust means upon actuation of said firing means, and said electrical energization means being responsive to said sensing means for changing relative electrical energizing of said first and second electromagnetic thrust means for minimizing shift in position of said feeding means in either of said first and second directions during subsequent forming of the material.

22. In a punch press, apparatus as claimed in claim 20, characterized in that:

sensing means are associated with said feeding means for sensing change in position of said feeding means in either said first or second direction during forming of the material between said first and second tools, control means are responsible to said sensing means, and said control means are connected to said first and second electromagnetic thrust means for changing the thrusting of at least one of said first and second electromagnetic thrust means during a subsequent operation of the punch press for reducing change in position of said feeding means during the subsequent operation.

23. In a punch press, apparatus as claimed in claim 20, further comprising:

means for indicating motion of the feeding means in either of said first and second directions during forming of the material between said first and second tools, and adjusting means for said resilient positioning means for adjusting resilient positioning of the feeding means prior to subsequent forming.

24. In a punch press apparatus as claimed in claim 22, in which:

said adjusting means adjusts resilient positioning of said feeding means for minimizing displacement of the material adjacent to a portion of the material being formed.

25. In a punch press, apparatus as claimed in claim 20, wherein:

said first member and said first electromagnetic thrust means comprise a first mass moving with said first tool, said second member and said second electromagnetic thrust means comprise a second mass moving with said second tool, and control means for controlling sudden electrical energization of said first and second electromagnetic thrust means for balancing at impact against opposite sides of the material momentum of said first mass with momentum of said second mass.

26. In a punch press, apparatus as claimed in claim 25, characterized in that:

said first and second masses are substantially equal, said control means controls sudden electrical energization of said first and second electromagnetic thrust means for accelerating said first member in said first direction and for accelerating said second member in said second direction with first and second accelerations, respectively, substantially matching each other.

27. In a punch press, apparatus as claimed in claim 26, characterized in that:

said control means causes said first and second tools substantially simultaneously to impact against opposite sides of the material with substantially equal velocities.

28. A punch press capable of punching and forming comprising:

mounting means mounting a plurality of guide pins in spaced, parallel orientation, a first motion member movable along said guide pins for carrying a first tool, a second motion member movable along said guide pins for carrying a second tool in opposed relationship with said first tool, material feeder means for feeding material into a region between said first and second tools for forming the material, said material feeder means being carried on said guide pins between said first and second motion members, said material feeder means being movable along said guide pins, first drive means coupled between said mounting means and said first motion member for accelerating said first motion member toward said second motion member, and second drive means coupled between said mounting means and said second motion member for accelerating said second motion member toward said first motion member for punching the material by impacting said first tool against a first side of the material at high velocity and impacting said second tool against a second side of the material at high velocity.

29. The punch press claimed in claim 29, further comprising:

spring means coupling said material feeder means to said mounting means for positioning said material feeder means relative to said mounting means, and said spring means allowing said material feeder means to move along said guide pins in response to impacting said first tool against a first side of the material at high velocity and impacting said second tool against a second side of the material at high velocity.

30. The punch press claimed in claim 28, in which:

adjusting means adjust said spring means for adjusting positioning of said material feeder means along said guide pins for adjusting positioning of the material in said region relative to said mounting means.

31. The punch press claimed in claim 28, in which:

said first drive means includes a first solenoid winding mounted on said mounting means and a first armature connected to said first motion member, said first armature is movable toward said second motion member, electrically energizing said first solenoid winding drives the first armature for accelerating said first motion member toward said second motion member, said second drive means includes a second solenoid winding mounted on said mounting means and a second armature connected to said second motion member, said second armature is movable toward said first motion member, electrically energizing said second solenoid winding drives the second armature for accelerating said second motion member toward said first motion member, and electrical energizing means connected to said first and second solenoid windings for simultaneously electrically energizing said first and second solenoid windings.

32. The punch press claimed in claim 31, in which:

control means are associated with said electrical energizing means for controlling energizing of said first and second solenoid windings for causing said first and second tools to impact substantially simultaneously with substantially equal momentum against opposite sides of the material.

33. The punch press claimed in claim 32, in which:

said control means includes sensing means for sensing shifting in position of said material feeder means along said guide pins.

34. The punch press claimed in claim 31, in which:

said first and second solenoid windings are substantially identical, said first and second armatures are substantially identical, moving mass associated with said first motion member and first armature is substantially equal with moving mass associated with said second motion member and second armature, and said electrical energizing means provides substantially equal energizing of said first and second solenoid windings.

35. The punch press claimed in claim 34, characterized by:

substantially equalizing momentum associated with said first tool in impacting against the material with momentum associated with said second tool in substantially simultaneously impacting against the material.

* * * * *